US009287632B2

(12) United States Patent
Manry, Jr. et al.

(10) Patent No.: US 9,287,632 B2
(45) Date of Patent: Mar. 15, 2016

(54) STRUCTURAL WIDEBAND MULTIFUNCTIONAL APERTURES

(71) Applicant: The Boeing Company, Chicago, IL (US)

(72) Inventors: Charles W. Manry, Jr., Auburn, WA (US); Manny S. Urcia, Bellevue, WA (US); David L. Banks, Renton, WA (US)

(73) Assignee: The Boeing Company, Chicago, IL (US)

( * ) Notice: Subject to any disclaimer, the term of this patent is extended or adjusted under 35 U.S.C. 154(b) by 408 days.

(21) Appl. No.: 13/691,309

(22) Filed: Nov. 30, 2012

(65) Prior Publication Data

US 2014/0152510 A1 Jun. 5, 2014

(51) Int. Cl.

| | |
|---|---|
| ***H01Q 1/38*** | (2006.01) |
| ***H01Q 21/06*** | (2006.01) |
| ***H01Q 1/28*** | (2006.01) |
| ***H01Q 1/42*** | (2006.01) |
| ***H01Q 9/04*** | (2006.01) |
| ***H01Q 9/28*** | (2006.01) |
| ***H01Q 21/00*** | (2006.01) |
| ***H01Q 21/26*** | (2006.01) |
| ***H01Q 25/00*** | (2006.01) |

(52) U.S. Cl.

CPC ..... *H01Q 21/061* (2013.01); *H01Q 1/286* (2013.01); *H01Q 1/38* (2013.01); *H01Q 1/42* (2013.01); *H01Q 9/0457* (2013.01); *H01Q 9/28* (2013.01); *H01Q 21/0075* (2013.01); *H01Q 21/0087* (2013.01); *H01Q 21/062* (2013.01); *H01Q 21/26* (2013.01); *H01Q 25/001* (2013.01); *Y10T 29/49016* (2015.01)

(58) Field of Classification Search

USPC ..... 343/700 MS, 702

See application file for complete search history.

(56) References Cited

U.S. PATENT DOCUMENTS

| | | | | |
|---|---|---|---|---|
| 4,477,813 | A * | 10/1984 | Weiss | H01Q 21/065 343/700 MS |
| 5,786,792 | A | 7/1998 | Bellus et al. | |
| 7,046,209 | B1 * | 5/2006 | McCarville | H01Q 1/286 343/700 MS |
| 2005/0146480 | A1 * | 7/2005 | Yazdandoost | H01Q 9/285 343/795 |
| 2007/0188398 | A1 | 8/2007 | Mohuchy et al. | |

FOREIGN PATENT DOCUMENTS

| | | |
|---|---|---|
| WO | WO 02/23669 A1 | 3/2002 |

OTHER PUBLICATIONS

Combined Search and Examination Report, EP13193852, Mar. 4, 2014.

(Continued)

*Primary Examiner* — Hoang V Nguyen
*Assistant Examiner* — Hai Tran
(74) *Attorney, Agent, or Firm* — McDonnell Boehnen Hulbert & Berghoff LLP

(57) ABSTRACT

A structural wideband multifunctional aperture and methods are presented. A ground plane grounds radio frequency (RF) and direct current (DC) electrical fields. A structural egg crate circuit board comprises a grid of circuit board planes coupled to the ground plane and perpendicular to the ground plane around open boxes. A signal feed-line is coupled to the structural egg crate circuit board and couple-able to a signal transmission line. A driven feed layer parallel to the ground plane is coupled to the signal feed-line and to a side of the structural egg crate circuit board opposite to the ground plane.

38 Claims, 11 Drawing Sheets

(56) References Cited

OTHER PUBLICATIONS

Manny Urcia et al: "Structurally integrated phased arrays", Aerospace Conference, 2011 IEEE, IEEE, Mar. 5, 2011, pp. 1-8, XP031937906, D01: 10.1109/AER0.2011.5747321, ISBN: 978-1-4244-7350-2.

* cited by examiner

STRUCTURAL WIDEBAND MULTIFUNCTIONAL APERTURES

FIELD

Embodiments of the present disclosure relate generally to antennas. More particularly, embodiments of the present disclosure relate to antenna structures.

BACKGROUND

Current microwave and millimeter-wave frequency antennas generally comprise cumbersome structures such as waveguides, dish antennas, helical coils, horns, and other large non-conformal structures. Communication applications where at least one communicator is moving and radar applications generally require a steerable beam and/or steerable reception. Phased array antennas are particularly useful for beam steered applications since beam steering can be accomplished electronically without physical motion of the antenna. Such electronic beam steering can be faster and more accurate and reliable than gimbaled/motor-driven mechanical antenna steering.

SUMMARY

A structural wideband multifunctional aperture and methods are presented. A ground plane grounds radio frequency (RF) and direct current (DC) electrical fields. A structural egg crate circuit board comprises a grid of circuit board planes coupled to the ground plane and perpendicular to the ground plane around open boxes. A set of feed-lines are coupled to the structural egg crate circuit board and comparable to signal transmission lines. A set of shorting-lines are coupled to the structural egg crate circuit board and to the ground plane. Opposite to the ground plane a driven feed layer parallel to the ground plane is coupled to the feed-lines and to a side of the structural egg crate circuit board. The shorting lines are also coupled to the driven feed layer and to a side of the structural egg crate circuit board. An antenna layer adjacent to and co-planar to the feed layer that is coupled to the feed layer. Above the antenna layer is a dielectric cover used to tune the RF performance of structural wideband multifunctional aperture.

In this manner, embodiments of the disclosure provide an antenna operable to function as a structure, and comprising elements with wide bandwidth and, for example, better than 50-degree conical scan volume that can be used for creation of conformal arrays and antennas. A design approach provides effective gain that can be, for example, within 2 to 3 dB of an ideal gain possible for a surface area of a unit-cell for the antenna element. The antenna element design can be used as a wide-band antenna and/or array. Embodiments of the disclosure can be used in multifunction and/or shared antenna configuration for communications, electronic warfare, and signal intelligence applications and multiple combinations of multiple applications. Embodiments of the disclosure provide wide-bandwidth coverage, and provide polarization diversity to allow transmission and reception of signals with arbitrary polarization that may comprise, but not exclusive to linear, circular, and slant polarized signals. Embodiments of the disclosure can be scaled to a frequency band with a matching bandwidth ratio (e.g., 5:1) from a highest to a lowest frequency of desired coverage.

The antenna integration into structure provides a significant advancement of aperture technologies over traditional apertures as traditional apertures are rigid/non-load bearing members and they are not allowed to flex. This limits the size and locations of apertures onto aircraft. Integrating the aperture into the structure allows: 1) a larger size aperture as the aperture is the structure of the aircraft, 2) for more flexibility of the location of the aperture on the platform, and 3) the aperture to be installed in small and medium UAV's adding to their mission capabilities.

In an embodiment, a structural wideband multifunctional aperture comprises a ground plane, a structural egg crate circuit board, a signal feed-line, and a driven feed layer. The ground plane grounds radio frequency (RF) and direct current (DC) electrical fields. The structural egg crate circuit board comprises a grid of circuit board planes coupled to the ground plane and configured perpendicular to the ground plane around open boxes. The signal feed-line is coupled to the structural egg crate circuit board and can couple to a signal transmission line. The driven feed layer is configured parallel to the ground plane and coupled to the signal feed-line and to a side of the structural egg crate circuit board opposite to the ground plane.

In another embodiment, a method for forming a structural wideband multifunctional aperture couples a structural egg crate circuit board comprising a grid of circuit board planes to a ground plane. The method further configures the structural egg crate circuit board perpendicular to the ground plane around open boxes, and couples a signal feed-line to the structural egg crate circuit board. The signal feed-line can couple to a signal transmission line. The method further configures a driven feed layer parallel to the ground plane, and couples the driven feed layer to the signal feed-line and to a side of the structural egg crate circuit board opposite to the ground plane.

In a further embodiment, a method for operating a structural wideband multifunctional aperture electromagnetically couples a signal feed-line to a signal transmission line. The signal feed-line is coupled to a structural egg crate circuit board comprising a grid of circuit board planes coupled to a ground plane and configured perpendicular to the ground plane around open boxes. The method further electromagnetically couples a driven feed layer to the signal feed-line. The driven feed layer is configured parallel to the ground plane and is coupled to the signal feed-line and to a side of the structural egg crate circuit board opposite to the ground plane.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
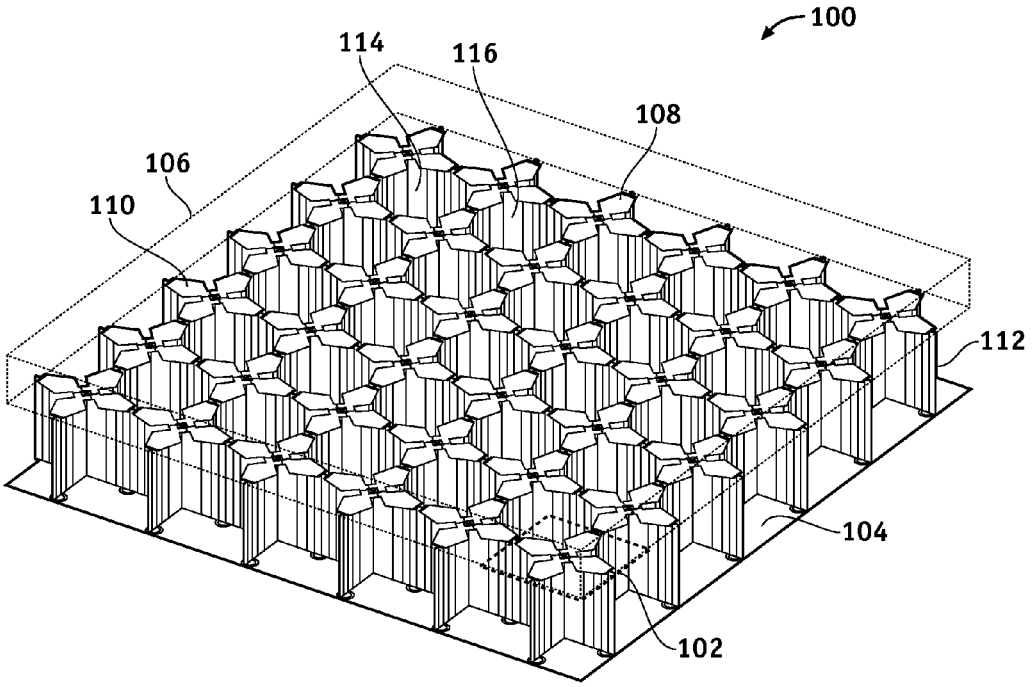
FIG. 1 is an illustration of an exemplary structural wideband multifunctional aperture comprising 6×6 unit cells in an egg crate configuration according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to antenna design, antenna manufacturing, and other functional aspects of systems described herein (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a non-limiting application, namely, a planar or conformal phased array antenna. Embodiments of the disclosure, however, are not limited to such planar or conformal phased array antenna applications, and the techniques described herein may also be utilized in other applications. For example but without limitation, embodiments may be applicable to manned and unmanned aircraft antennas, sensor antennas, radar antennas, non-conformal antennas, non-planar antennas, and other antenna and phased array applications.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

A compact array element with wide bandwidth coverage, wide field of view better than 55 degrees from normal to an antenna face, and polarization diversity is not a capability of current designs. Co-planar broadband-antennas based on Vivaldi type (e.g., a dielectric plate metalized on both sides) antenna elements cannot scan beyond 45 degrees while maintaining their bandwidth, spiral antennas are too large or deep for practical usage, a current sheet antenna based on wire dipoles has demonstrated 9:1 bandwidth coverage but requires the use of feed posts and external RF hybrids. Connected arrays over a ground plane have low efficiency. Spiral based elements do not provide polarization diversity. Other wide band planar elements based on similar concepts require the use of machined feed posts and 180-degree hybrids.

Embodiments of the disclosure provide an antenna element that can be used in creation of wide-band arrays and/or conformal antennas. The wide-band arrays and/or conformal antennas can achieve wide bandwidth (e.g., 5:1 ratio), can have an ability to achieve wide scan angles, and can provide both dual and separable RF polarization capability. The antennas have a wide applicability to communication utilizing phased antenna arrays, signal intelligence sensors and detection sensor arrays, wide band radar systems, and phased arrays used in electronics warfare. The antenna element can be used as a shared and/or multifunction RF antenna system. The antenna element can achieve, for example, 5:1 or better bandwidth in both voltage standing wave ratio (VSWR) and gain.

FIG. 1 is an illustration of an exemplary structural wideband multifunctional aperture 100 comprising an array of unit cells in an egg crate configuration according to an embodiment of the disclosure. The structural wideband multifunctional aperture 100 comprises a plurality of unit cells 102 coupled to a ground plane 104 and covered by a dielectric cover 106. The unit cells 102 comprise bow-tie antenna elements 108/110 coupled to a structural egg crate circuit board 112. In an alternate embodiment, the exemplary structural wideband multifunctional aperture 100 and unit cell 102 may be comprised of only one set of antenna elements (108 or 110) to form a single polarized aperture.

The dielectric cover 106 may comprise, for example but without limitation, a single layer comprising low electromagnetic loss material, a plurality of layers comprising differing low electromagnetic loss materials, or other configuration.

The structural egg crate circuit board 112 comprises a grid of circuit board planes coupled to the ground plane 104 and is configured perpendicular to the ground plane 104 around a plurality of open boxes 114/116. The structural egg crate circuit board 112 may comprise a low dielectric quartz fabric, which is compatible with high temperature and provides high strength structural integrity. Such quartz fabrics may comprise, for example but without limitation, 99.95% SiO2 quartz crystals providing low dielectric loss properties. Astroquartz™ is such a quartz fabric providing low dielectric, near zero coefficient of thermal expansion, high temperature performance and structural mechanical properties in composites.

The open boxes 114/116 may be filled with a low dielectric material comprising, for example but without limitation, a low dielectric foam, an aerogel, a SEAgel, or other low dielectric constant material. The structural wideband multifunctional aperture 100 can function as a structural sandwich panel as a load-bearing member. For example, the structural wideband multifunctional aperture 100 may comprise an aircraft skin. The structural wideband multifunctional aperture 100 is not limited for integration into an aircraft skin, and skin of other vehicles such as, but without limitation, manned and unmanned ground vehicles, spacecraft, submarines, or other vehicles, may also be used to conform the structural wideband multifunctional aperture 100 thereto.

Figure 11:
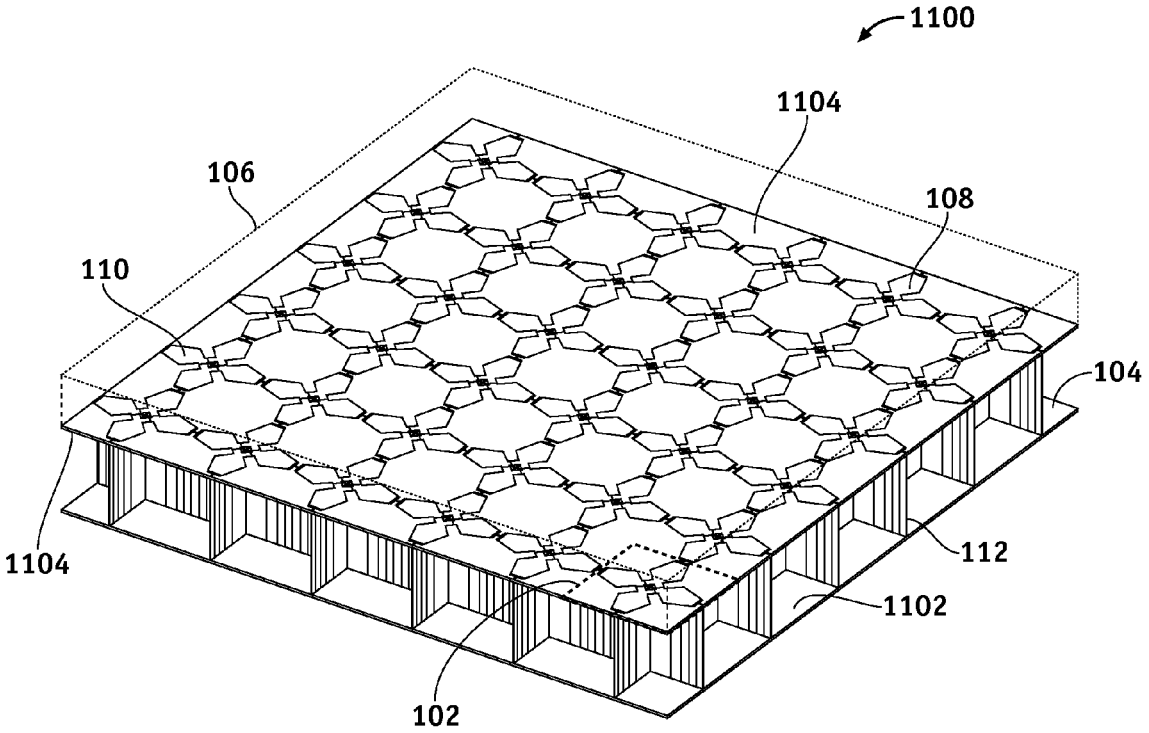
FIG. 11 is an illustration of an exemplary structural wideband multifunctional aperture comprising a sandwich panel configuration according to an embodiment of the disclosure.
Figure 12:
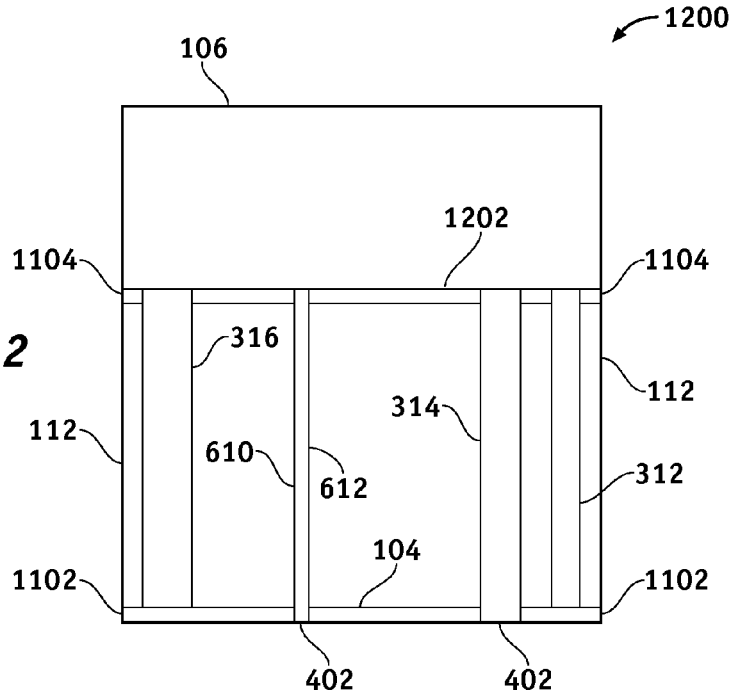
FIG. 12 is an illustration of an expanded view of the sandwich panel configuration of FIG. 11.

The structural wideband multifunctional aperture 100 may be configured as a sandwich panel 100 such as a sandwich panel 1100 (FIGS. 11, 12) comprising the structural egg crate circuit board 112 sandwiched between the dielectric cover 106 and/or additional facing sheets (1104, FIGS. 11, 12) and the ground plane 104 and/or additional backing sheets (1102, FIGS. 11, 12). The bow-tie antenna elements 108/110, signal feed-lines 312 (FIG. 3), grounded shorting-lines 314 (FIG. 3), and grounded shorting-lines 316 (FIG. 3) are to be configured in the sandwich panel 100/1100. The dielectric cover 106 incorporates bow-tie antenna elements 108/110, and the structural egg crate circuit board 112 incorporates the signal feed-lines 312, the grounded shorting-lines 314, and the grounded shorting-lines 316.

The structural wideband multifunctional aperture 100 (sandwich panel 100) may be integrated into a structure of a vehicle such as an aircraft. For example, the structural wideband multifunctional aperture 100 may be integrated into an outer composite skin of the aircraft. Furthermore, electronics can be attached to a backside behind the ground plane 104. The structural wideband multifunctional aperture 100 is configured to function under a structural loading of the aircraft. Furthermore, the bow-tie antenna elements 108/110, the signal feed-lines 312, the grounded shorting-lines 314, the grounded shorting-lines 316, and other interconnects, connections, and electronics are configured to function under a structural loading of the aircraft.

Figure 2:
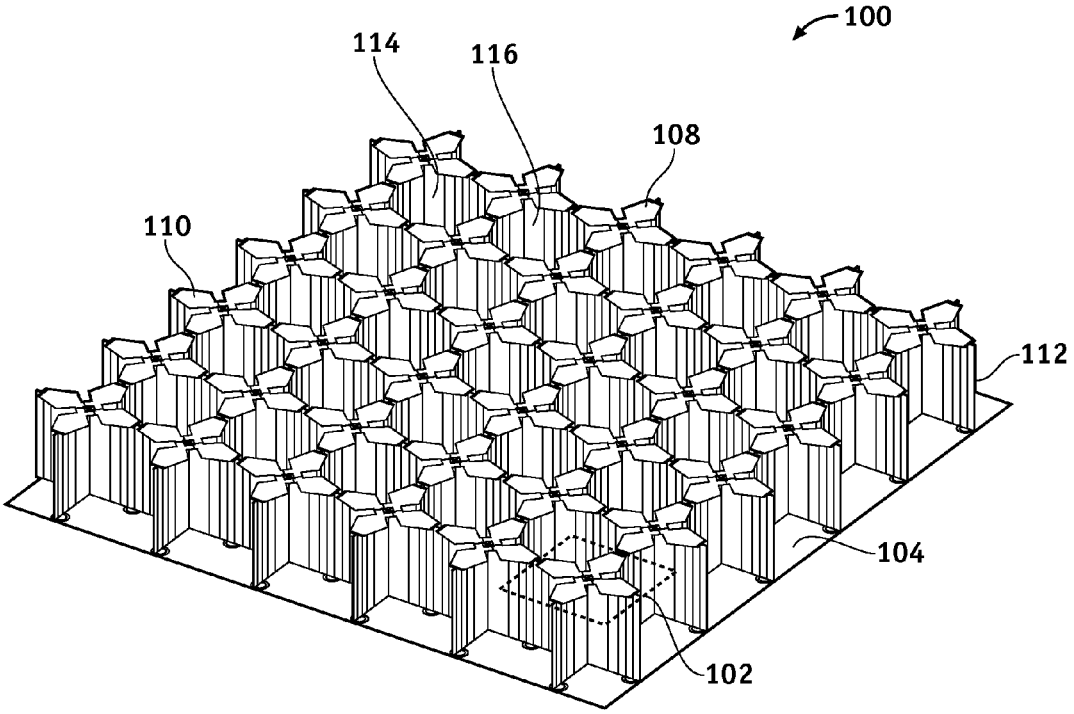
FIG. 2 is an illustration of the structural wideband multifunctional aperture of FIG. 1 with a dielectric cover removed.

FIG. 2 is an illustration of the structural wideband multifunctional aperture 100 of FIG. 1 with the dielectric cover 106 removed. The structural wideband multifunctional aperture 100 may target, for example, a lower frequency wideband element. The bow-tie antenna elements 108/110 allow for an egg-crate configuration such as the structural egg crate circuit board 112 that enables an array of the structural wideband multifunctional aperture 100 to be designed and built to carry structural loads. The structural wideband multifunctional aperture 100 allows for a wide band array that is thin and light as well. There is more flexibility with a location of the structural wideband multifunctional aperture 100 on a platform such as an aircraft and a size of the structural wideband multifunctional aperture 100 has a potential to be as large as the structure is the aircraft. The ability of the structural wideband multifunctional aperture 100 to carry structural loads while providing wide bandwidth allows the aperture to be installed in small and medium UAV's adding to their mission capabilities they would otherwise not have.

Figure 3:
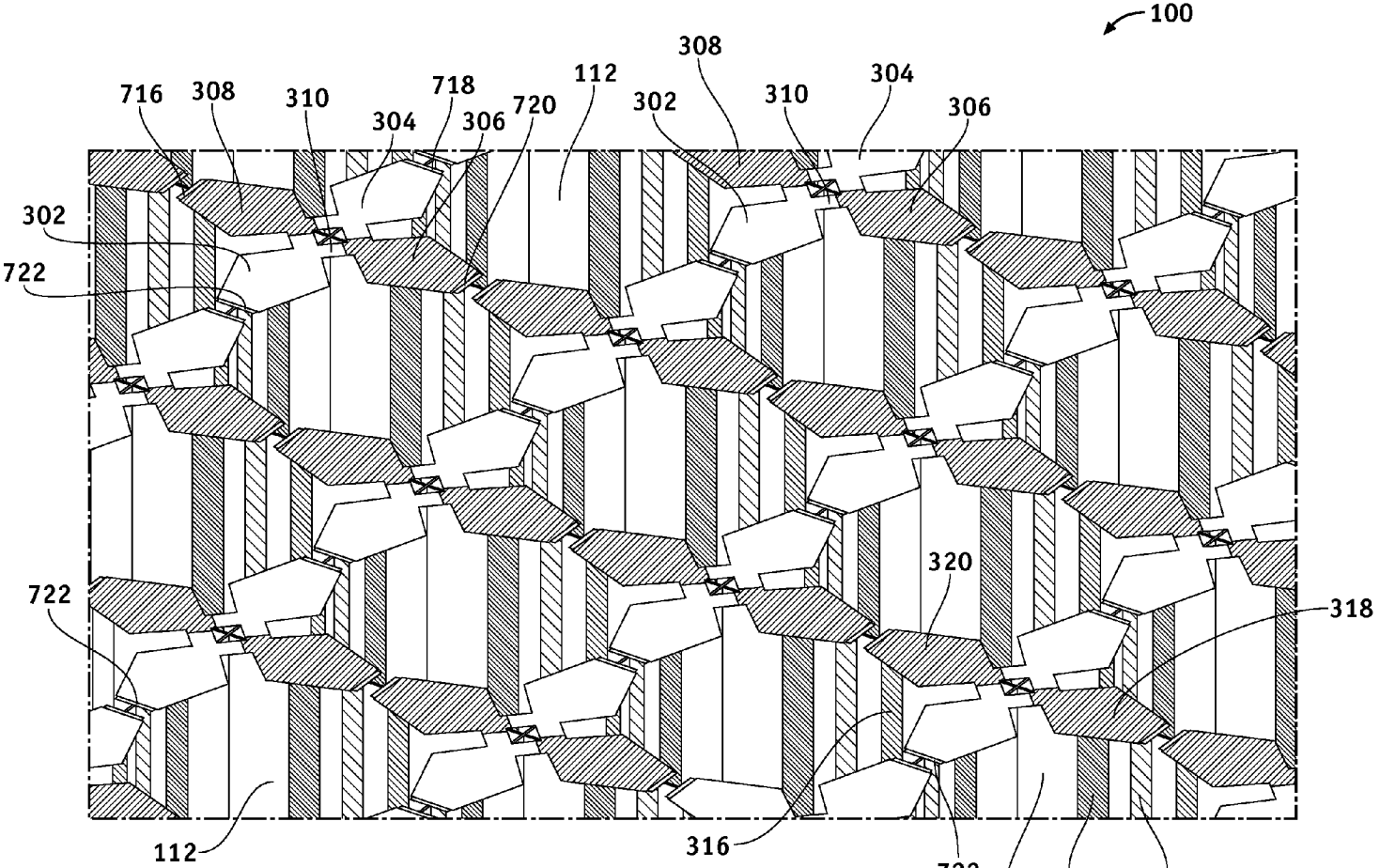
FIG. 3 is an illustration of an expanded view of the structural wideband multifunctional aperture of FIG. 2.

FIG. 3 is an illustration of an expanded view of the structural wideband multifunctional aperture 100 of FIG. 2. A first bow-tie antenna element 302/304 comprises a driven bow-tie arm 302 and a ground shorted bow-tie arm 304. The driven bow-tie arm 302 and the grounded bow-tie arm 304 may function as dipole antennas. A second bow-tie antenna element 306/308 comprises a driven bow-tie arm antenna element 306 and a grounded bow-tie arm antenna element 308. The first bow-tie antenna element 302/304 and the second bow-tie antenna element 306/308 may overlap at an overlap region 310. The overlap region 310 may provide capacitive coupling between the first bow-tie antenna element 302/304 and the second bow-tie antenna element 306/308.

Figure 4:
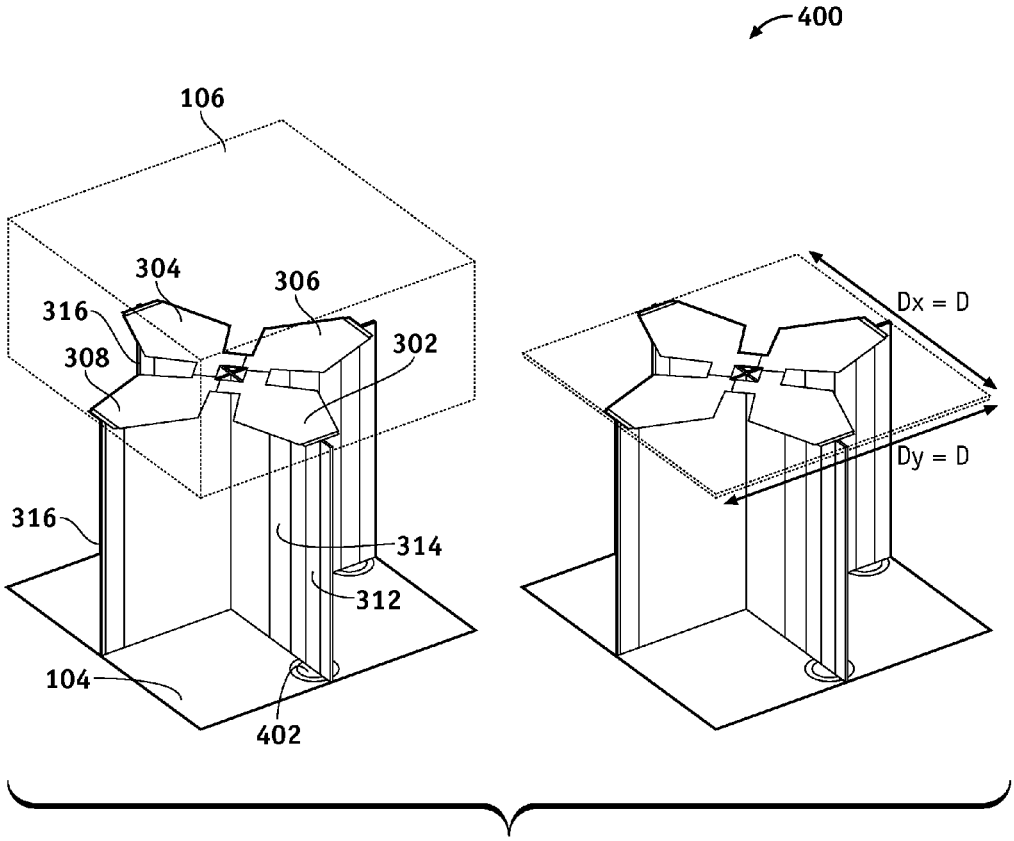
FIG. 4 is an illustration of an exemplary unit cell according to an embodiment of the disclosure.
Figure 5:
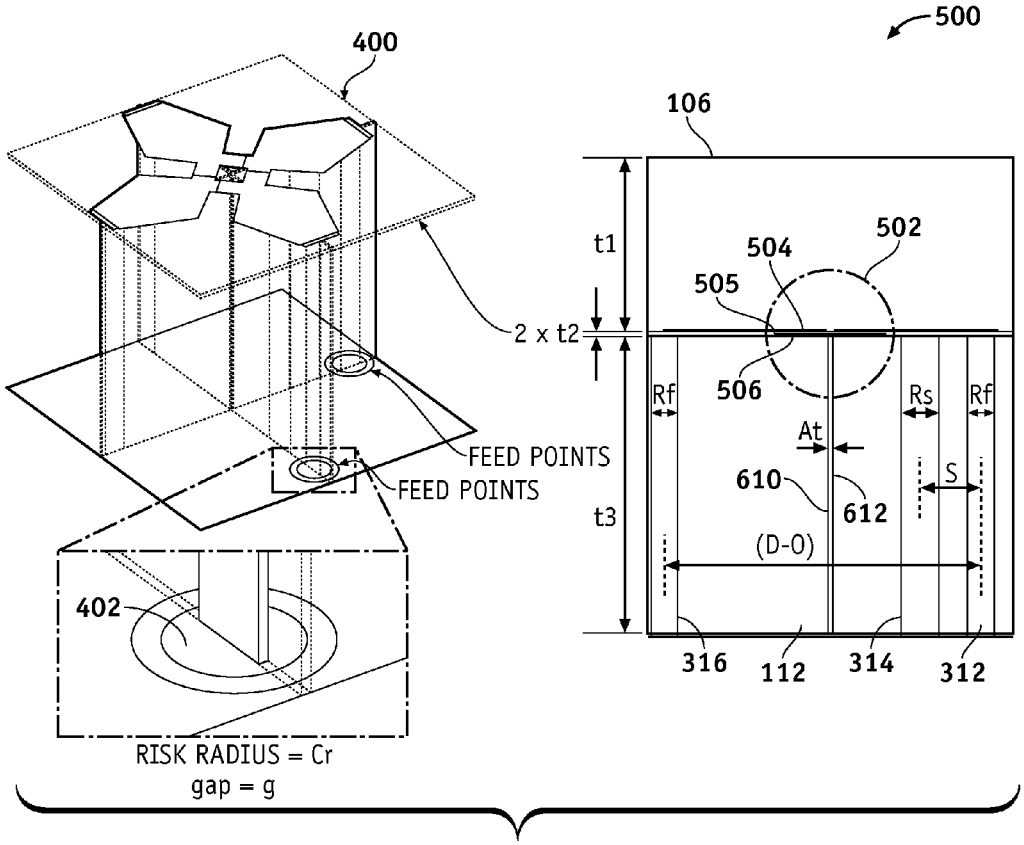
FIG. 5 is an illustration of an exemplary cross section or a unit cell in relation to a unit cell according to an embodiment of the disclosure.

Referring for this paragraph to FIGS. 3-7, the first bow-tie antenna element 302/304 and the second bow-tie antenna element 306/308 are driven by signal feed-line 312 and grounded shorting-lines 314 and 316 coupled to the structural egg crate circuit board 112. For example, a driven bow-tie antenna arm 302 in an antenna layer 504 (FIG. 5, 6, 7) is electromagnetically coupled to (and may be driven by) a bow-tie antenna feed layer element 722 (FIG. 3, 7) in a combined antenna/feed layer 505 (FIG. 5, 6, 7) coupled to a drive/feed-line 312 coupled to a signal transmission line 402 (FIG. 4). The bow-tie antenna feed layer element 722 may be further coupled to a grounded shorting-line 314 coupled to the ground plane 104 grounding the bow-tie antenna feed layer element 722. A ground shorted bow-tie antenna arm 304 in antenna layer 504 is electromagnetically coupled to a bow-tie antenna feed layer element 718 (FIG. 3, 7) in the combined antenna/feed layer 505 (FIG. 5, 6, 7). The bow-tie antenna feed layer element 718 is coupled to a grounded shorting-line 316 coupled to the ground plane 104 grounding the bow-tie antenna feed layer element 718. Similarly, a driven bow-tie arm antenna element 306 in the combined antenna/feed layer 505 is electromagnetically coupled to (and may be driven by) a bow-tie antenna feed layer element 720 (FIG. 7) in a feed layer 506 (FIG. 5, 6, 7). Also, a ground shorted bow-tie antenna arm 308 in the combined antenna/feed layer 505 is electromagnetically coupled to a bow-tie antenna feed layer element 716 (FIG. 7) in the feed layer 506.

The terms antenna layer, antenna layer element, bow-tie antenna element, bow-tie antenna arm, bow-tie arm antenna element, and the like may be used interchangeably in this document. Also, the terms feed layer, feed layer element, bow-tie feed layer element, bow-tie feed layer arm, bow-tie arm feed layer element, and the like may be used interchangeably in this document.

The structural wideband multifunctional aperture 100 comprises the bow-tie antenna elements 108/110 in an egg-crate configuration comprising capacitive bow-tie or dipole-like feeds either underneath a set of capacitively linked bow-tie or dipole-like arms such as the driven bow-tie arm 302. The feed layer 506 and the driven bow-tie arm 318 can be interchanged to create different configurations. Two elements on the feed layer 506 are connected to an RF source or receiver via the feed-line 312 that can be directly connected to an RF connector to provide, for example, about 3:1 or better bandwidth. The feed-line 312 can also be connected by capacitive coupling to a Z-transformer stripline to provide wider bandwidth by adding two additional layers below the structural wideband multifunctional aperture 100. The addition of the Z-transformer stripline provides an ability to achieve, for example, about 5:1 or better bandwidth. Shorting traces such as the grounded shorting-lines 314 and 316 are added in tune the overall structural wideband multifunctional aperture 100 to avoid in-band resonances causing nulls in RF performance.

FIG. 4 is an illustration of an exemplary unit cell 400 (e.g., unit cell 102 of the structural wideband multifunctional aperture 100 in FIG. 1) according to an embodiment of the disclosure. The unit cell 400 comprises a dimension Dx in an X direction and a dimension Dy in a Y direction. The unit cell 400 may be symmetric, wherein the dimension Dx and the dimension Dy equal a same length D comprising, for example but without limitation, about 24.5 mm, or other suitable length. In other embodiments, the dimension Dx and the dimension Dy may comprise dissimilar values. The bow-tie antenna elements 108 of the structural wideband multifunctional aperture 100 may comprise the first bow-tie antenna element 302/304, and the bow-tie antenna elements 110 of the structural wideband multifunctional aperture 100 may comprise the second bow-tie antenna element 306/308.

The structural wideband multifunctional aperture 100 comprises the bow-tie antenna elements 108/110 with wide bandwidth and better than, for example, about 50-degree conical scan volume that can be used for creation of conformal arrays and antennas. The structural wideband multifunctional aperture 100 provides effective gain within, for example, about 2 to 3 dB of an ideal gain possible for a surface area of a unit-cell for an antenna element. The structural wideband multifunctional aperture 100 can be used as a wideband antenna and/or array. The structural wideband multifunctional aperture 100 can be used in multifunction and/or shared antenna configuration for communications, electronic warfare, and signal intelligence applications and multiple combinations of multiple applications. The structural wideband multifunctional aperture 100 not only provides wide-bandwidth coverage it also provides polarization diversity to allow the transmission and reception of signals with any arbitrary polarization that comprises, for example but without limitation linear, circular, slant polarized signals, and other polarization signal. The structural wideband multifunctional aperture 100 can be scaled to any frequency band with a matching bandwidth ratio (e.g. about, 5:1) from the highest to the lowest frequency of a desired coverage.

FIG. 5 is an illustration of an exemplary cross section 500 of the unit cell 400 in FIG. 4 according to an embodiment of the disclosure. As shown in the cross section 500, a depth t1 of the dielectric cover 106 may comprise, for example but without limitation, about 10 mm, or other suitable thickness. A height t3 of the structural egg crate circuit board 112 may comprise, for example but without limitation, about 14 mm, or other suitable height. A thickness of t2 between the antenna layer 504, and the combined antenna/feed layer 505, and also between the combined antenna/feed layer 505 and the feed layer 506, may comprise, for example but without limitation, about 0.13 mm (5 mils), or other suitable thickness. The circuit board materials used to form the layers 504, 505 and layer 506 may comprise, for example but without limitation, Rogers 6002™ or other circuit board materials. A width Rf of the drive-line 312, a width Rs of the grounded shorting-line 314, and a width Rf of the grounded shorting-line 314 may comprise, for example but without limitation, about 1 mm each, or other suitable width.

A spacing S between the drive feed-line 312 and the grounded shorting-line 314 may comprise, for example but without limitation, about 4.1 mm, or other suitable spacing. A risk radius Cr and a gap g of the signal transmission line 402 may comprise, for example but without limitation, about 1.3 mm and 0.5 mm respectively, or other suitable radius and gap. A distance D-O between the drive feed-line 312 and the grounded shorting-line 316 may comprise, for example but without limitation, about 10 mm, or other suitable distance.

Integration of the structural wideband multifunctional aperture 100 into a structure provides a significant advancement of aperture technologies over traditional apertures as traditional apertures are rigid/non-load bearing members and they are not allowed to flex. This limits the size and locations of traditional apertures onto a vehicle such as an aircraft. Integrating the structural wideband multifunctional aperture 100 into a structure such as an aircraft structure: allows 1) a larger size aperture as the aperture comprise the structure of the aircraft, 2) for more flexibility of the location of the aperture on the aircraft structure, and 3) the aperture to be installed in small and medium UAV's adding to their mission capabilities.

Figure 6:
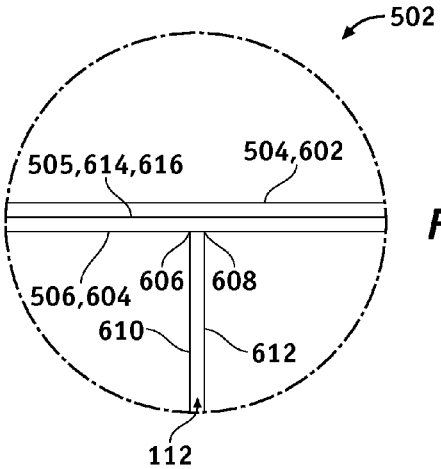
FIG. 6 is an illustration of an expanded view of a cross section of the of the antenna layer, combined antenna/feed layer, and the feed layer of FIG. 5 according to an embodiment of the disclosure.
Figure 7:
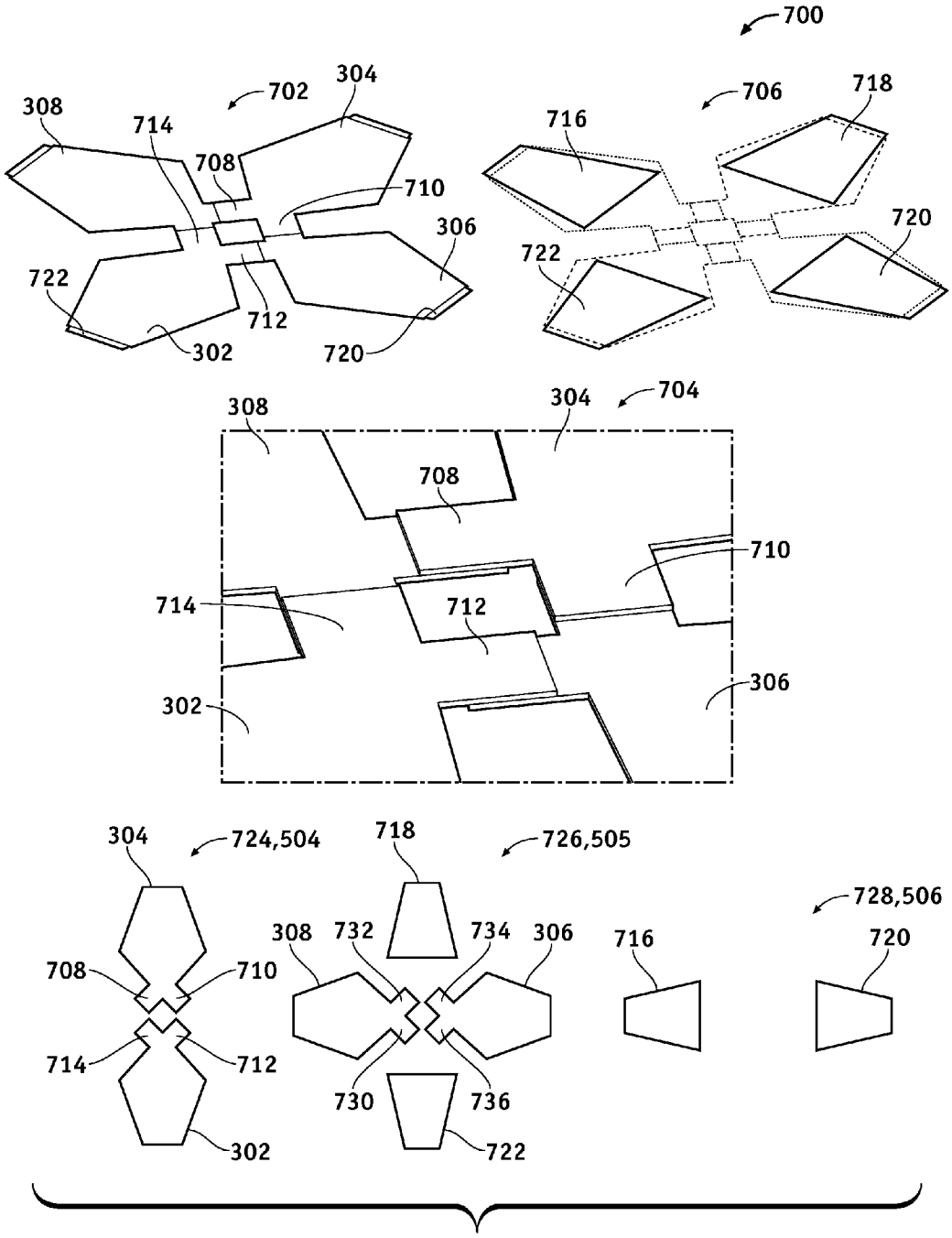
FIG. 7 is an illustration of an exemplary antenna assembly comprising feed layer and antenna layer elements according to an embodiment of the disclosure.

FIG. 6 is an illustration of an expanded view of a cross section of the antenna layer 504, the combined antenna/feed layer 505, and the feed layer 506 of FIG. 5 according to an embodiment of the disclosure. The antenna layer 504 may comprise an antenna element 602 such as the driven bow-tie arm 302 and the grounded bow-tie arm 304. The combined antenna/feed layer 505 may comprise an antenna element 614 such as the driven bow-tie arm antenna element 306 and the grounded bow-tie arm 308, and/or a feed element 616 such as the bow-tie antenna feed layer elements 718 and 722 (FIGS. 3, 7). The feed layer 506 may comprise a feed element 604 such as the bow-tie antenna feed layer elements 716 and 720 (FIG. 3, 7).

The antenna element 602 of the antenna layer 504 is electromagnetically coupled to the feed element 616 of the combined antenna/feed layer 505. The antenna element 614 of the combined antenna/feed layer 505 is electromagnetically coupled to the feed element 604 of the feed layer 506. The feed elements 604 and 616 are coupled to the feed-line 312, the grounded shorting-line 314 and/or the grounded shorting-line 316 coupled to the structural egg crate circuit board 112 (FIG. 1). The feed-line 312, the grounded shorting-line 314 and the grounded shorting-line 316 may each comprise a first side lead 610 coupled to a first side of the structural egg crate circuit board 112, a second side lead 612 coupled to a second side of the structural egg crate circuit board 112, or both the first side lead 610 and the second side lead 612 coupled to the structural egg crate circuit board 112.

The first side lead 610 and the second side lead 612 are coupled to the structural egg crate circuit board 112 by a first joint 606 and a second joint 608 respectively. The first joint 606 and the second joint 608 may comprise, for example but without limitation, a weld, a diffusion bond, a solder, or suitable other coupling. A width At of the structural egg crate circuit board 112 and also a spacing At between the first side lead 610 and the second side lead 612 may comprise, for example but without limitation, about 0.1 mm, or other suitable width or spacing.

FIG. 7 is an illustration of an exemplary antenna assembly 700 comprising feed layer and antenna layer elements according to an embodiment of the disclosure. An antenna assembly 702 may comprise an antenna layer such as the antenna layer 504 comprising the antenna elements 302, 304, 306 and 308 overlaying the feed layer elements 722, 718, 720 and 716 respectively. A bow-tie antenna element 302/304 comprises the antenna arm element 302 comprising an overlap leaf 712 and an overlap leaf 714, and the antenna arm element 304 comprising an overlap leaf 708 and an overlap leaf 710. A bow-tie antenna element 306/308 comprises the antenna element 306 comprising an overlap leaf 734 and an overlap leaf 736, and the antenna element 308 comprising an overlap leaf 732 and an overlap leaf 734. The bow-tie antenna element 302/304 is configured in a first layer (Layer 1: 724) along a Y-Axis (not shown), and the bow-tie antenna element 306/308 is configured in a second layer (Layer 2: 726) along an X-Axis (not shown).

The bow-tie antenna element 302/304 is electromagnetically coupled to the feed layer element 722/718, and the bow-tie antenna element 306/308 is electromagnetically coupled to the feed layer element 720/716 (Layer 3: 728).

The overlap leaf 708 overlays and is capacitively coupled to the overlap leaf 732. The overlap leaf 710 overlays and is capacitively coupled to the overlap leaf 734. The overlap leaf 712 overlays and is capacitively coupled to the overlap leaf 736. The overlap leaf 714 overlays and is capacitively coupled to the overlap leaf 730.

The antenna elements 302, 304, 306 and 308 may be capacitively coupled in an overlap area 704. The antenna arm element 302 is capacitively coupled to the antenna arm element 304 by the overlap leafs 708-712 and 730-736. The antenna element 306 is capacitively coupled to the antenna element 308 by the overlap leafs 708-712 and 730-736.

In some embodiments, the Y-axis layer (Layer 1: 724) and the X-axis layer (Layer 2: 726) may have different parameters and/or resemble other bow-tie or dipole shapes. In some embodiments, the antenna assembly 702/700 can be single polarized comprising of only one set of antenna arms and feeds such as one of the bow-tie antenna element 302/304 and the bow-tie antenna element 306/308. Selections of materials and number of layers, for a circuit card and materials below and above an antenna circuit board are also part of the design. Embodiments of disclosure provide a means for use of a 3 layer combined antenna design with the structural egg crate circuit board 112 (FIG. 1). An important feature is the use of a 3 layer antenna board design that allows the structural wideband multifunctional aperture 100 to be configured in an egg-crate layout such as the structural egg crate circuit board 112. Addition of bow-tie or dipole shapes on layers 2 (726) and 3 (728) to capacitively feed the end cross-element configuration dual polarized elements on layers 1 (724) and 2 (726) allows for the egg crate layout.

Figure 8:
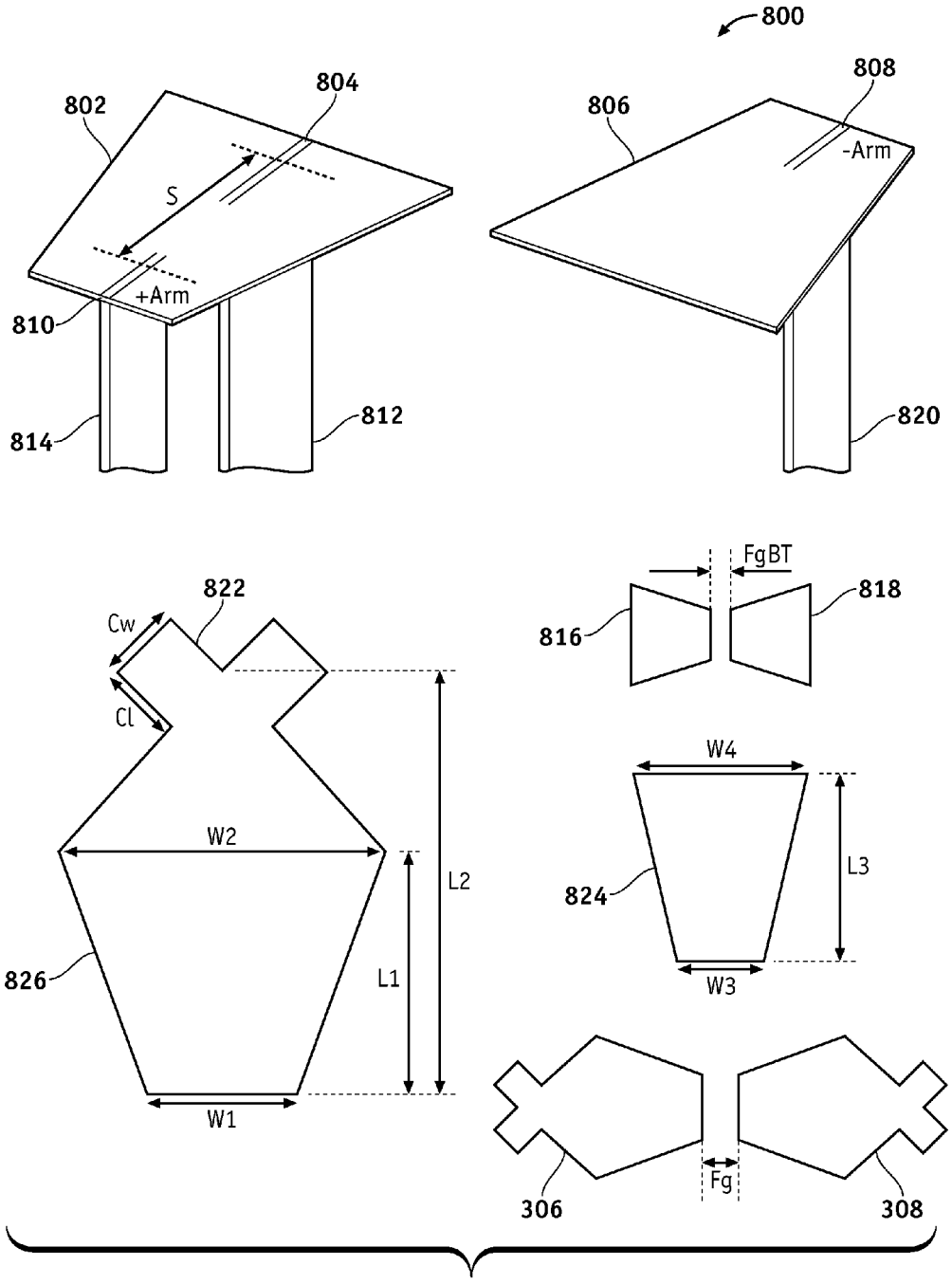
FIG. 8 is an illustration of exemplary feed layer element dimensions and antenna layer element dimensions according to an embodiment of the disclosure.

FIG. 8 is an illustration of exemplary feed layer element dimensions and antenna layer element dimensions according to an embodiment of the disclosure. A feed layer element 802 may comprise a driven feed layer element such as the feed layer elements 720 and 722 (FIGS. 3, 7). A feed layer element 806 may comprise a ground shorted feed layer element such as the feed layer elements 716 and 718 (FIGS. 3, 7). An antenna layer element 826 may comprise a driven bow-tie antenna layer element such as the driven bow-tie arm antenna layer element 302 and 306 (FIGS. 3, 7) or the grounded bow-tie arm antenna layer element 304 and 308 (FIGS. 3, 7). Representative parameters for, for example but without limitation, a 1.2 GHz to 6 GHz design are described below.

The feed layer element 802 is coupled to a feed line 814 (e.g., 312 in FIGS. 3, 5, 12) at a joint 810 and a grounded shorting-line 812 (e.g., 314 in FIGS. 3, 5, 12) at a joint 804. The spacing S between the feed line 814 and the grounded shorting-line 812 may comprise, for example but without limitation, about 4.1 mm, or other suitable spacing. The feed layer element 806 is coupled to a grounded shorting-line 820 (e.g., 316 in FIGS. 3, 5, 12). A gap between adjacent feed layer elements FgBT such as between a feed layer element 816 and a feed layer element 818 may comprise, for example but without limitation, about 2 mm, or other suitable gap. A feed layer 824 may comprise, for example but without limitation, a length L3 of about 6.5 mm, an outer width W3 of about 3 mm, an inner width W3 of about 6 mm, or other suitable dimensions.

The antenna layer element 826 may comprise, for example but without limitation, a length-to-maximum-width L1 of about 5.6 mm, a length L2 of about 9.8 mm, an end width W1 of about 3.5 mm, a maximum-width W2 of about 7.5 mm, or other suitable dimensions. An antenna overlap leaf 822 may comprise, for example but without limitation, a leaf length Cl of about 1.7 mm, a leaf width Cw of about 1.75 mm, or other suitable dimensions. An adjacent antenna element gap Fg between adjacent antenna elements such as between the driven bow-tie arm antenna element 306 of a first unit cell and the grounded bow-tie arm antenna element 308 of a second unit cell may comprise, for example but without limitation, about 1.5 mm, or other suitable gap.

Figure 9:
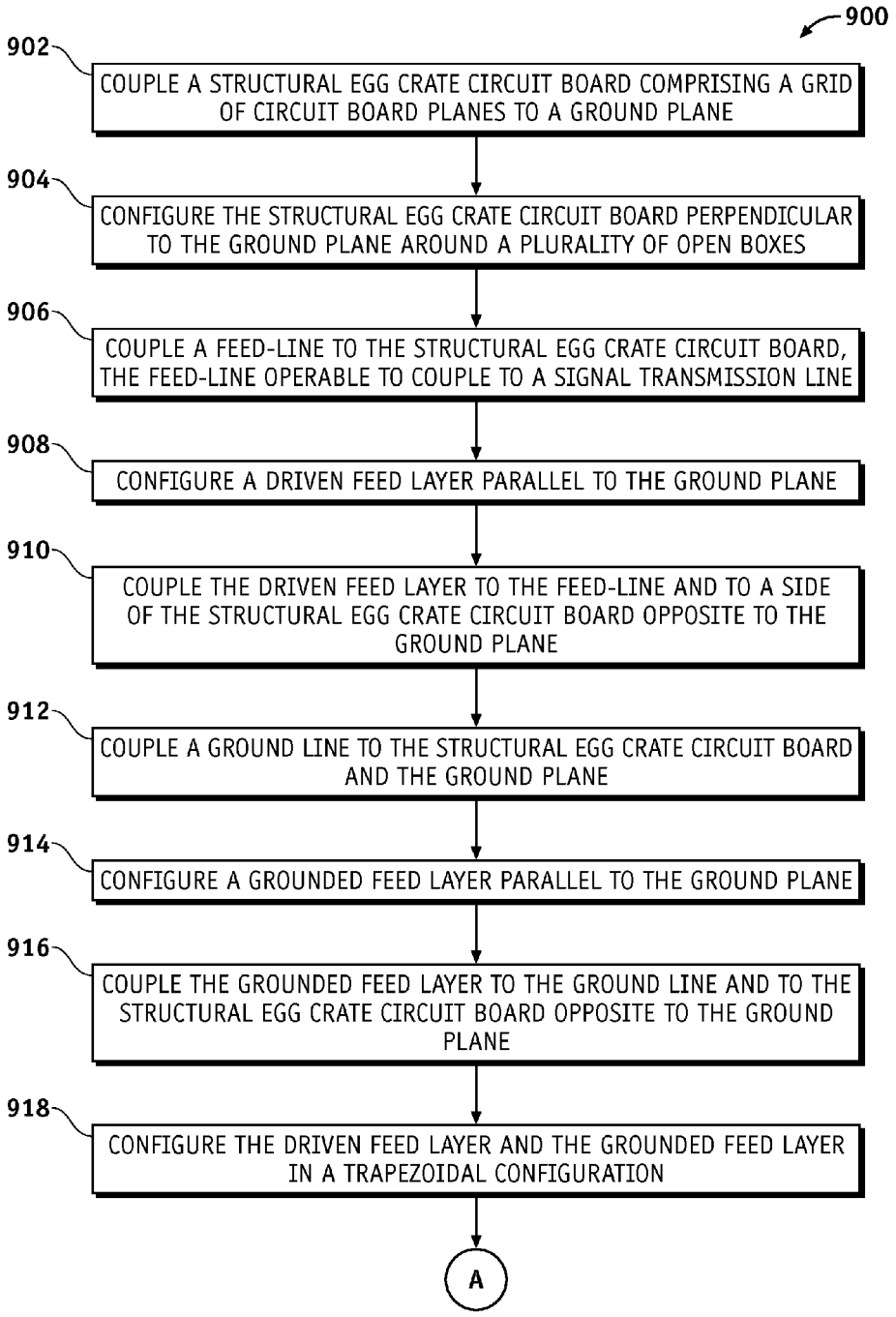
FIG. 9 is an illustration of an exemplary process for forming a structural wideband multifunctional aperture according to an embodiment of the disclosure.
Figure 9:
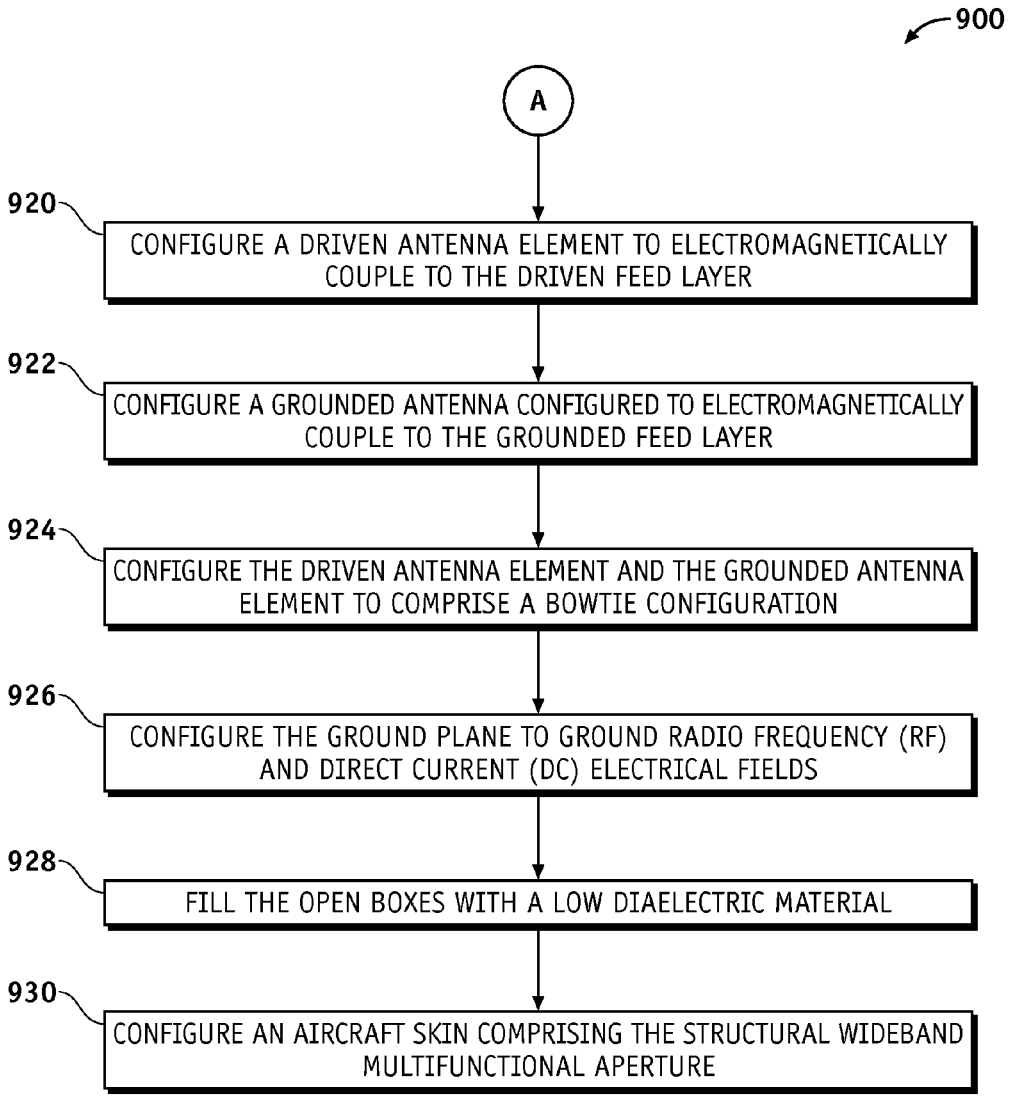

FIG. 9 is an illustration of an exemplary process 900 for forming a structural wideband multifunctional aperture according to an embodiment of the disclosure. The various tasks performed in connection with process 900 may be performed by software, hardware, firmware, computer-readable software, computer readable storage medium, a computer-readable medium comprising computer executable instructions for performing the process method, mechanically, or any combination thereof. The process 900 may be recorded in a computer-readable medium such as a semiconductor memory, a magnetic disk, an optical disk, and the like, and can be accessed and executed, for example, by a computer CPU in which the computer-readable medium is stored.

For illustrative purposes, the following description of process 900 may refer to elements mentioned above in connection with FIGS. 1-2. In some embodiments, portions of the process 900 may be performed by different elements of the structural wideband multifunctional aperture 100 such as: the structural egg crate circuit board 112, the feed-line 312, the grounded shorting-line 314 the grounded shorting-line 316, etc. It should be appreciated that the process 900 may include any number of additional or alternative tasks, the tasks shown in FIG. 9 need not be performed in the illustrated order, and the process 900 may be incorporated into a more comprehensive procedure or process having additional functionality not described in detail herein. Process 900 may comprise functions, material, and structures that are similar to the embodiments shown in FIGS. 1-2. Therefore, common features, functions, and elements may not be redundantly described here.

Process 900 may begin by coupling a structural egg crate circuit board 112 comprising a grid of circuit board planes to a ground plane 104 (task 902).

Process 900 may continue by configuring the structural egg crate circuit board 112 perpendicular to the ground plane 104 around a plurality of open boxes 114/116 (task 904).

Process 900 may continue by coupling a signal feed-line 312 to the structural egg crate circuit board 112, the signal feed-line 312 operable to couple to a signal transmission line 402 (task 906).

Process 900 may continue by configuring a driven feed layer 722/720 parallel to the ground plane 104 (task 908). The driven feed layer 722/720 may comprise a single driven feed layer element 722/720, or any suitable number of the feed layer elements 722/720.

Process 900 may continue by coupling the driven feed layer 722/720 to the signal feed-line 312 and to a side of the structural egg crate circuit board opposite to the ground plane 104 (task 910).

Process 900 may continue by coupling a grounded shorting-line 314/316 to the structural egg crate circuit board 112 and the ground plane 104 (task 912).

Process 900 may continue by configuring a grounded feed layer 716/718 parallel to the ground plane 104 (task 914). The grounded feed layer 716/718 may comprise a single driven grounded feed layer element 716/718, or any suitable number of the grounded feed layer elements 716/718.

Process 900 may continue by coupling the grounded feed layer 716/718 to the grounded shorting-line 316 and to the structural egg crate circuit board 112 opposite to the ground plane 104 (task 916).

Process 900 may continue by configuring the driven feed layer 722/720 and the grounded feed layer 716/718 in a trapezoidal configuration (task 918).

Process 900 may continue by configuring a driven antenna element 302/306 to electromagnetically couple to the driven feed layer 722/720 (task 920).

Process 900 may continue by configuring a grounded antenna element 304/308 to electromagnetically couple to the grounded feed layer (task 922).

Process 900 may continue by configuring the driven antenna element 302/306 and the grounded antenna element 304/308 to comprise a bow-tie configuration (task 924).

Process 900 may continue by configuring the ground plane 104 to ground radio frequency (RF) and direct current (DC) electrical fields (task 926).

Process 900 may continue by filling the open boxes 114/116 with a low dielectric material (task 928).

Process 900 may continue by configuring an aircraft skin comprising the structural wideband multifunctional aperture 100 (task 930).

Figure 10:
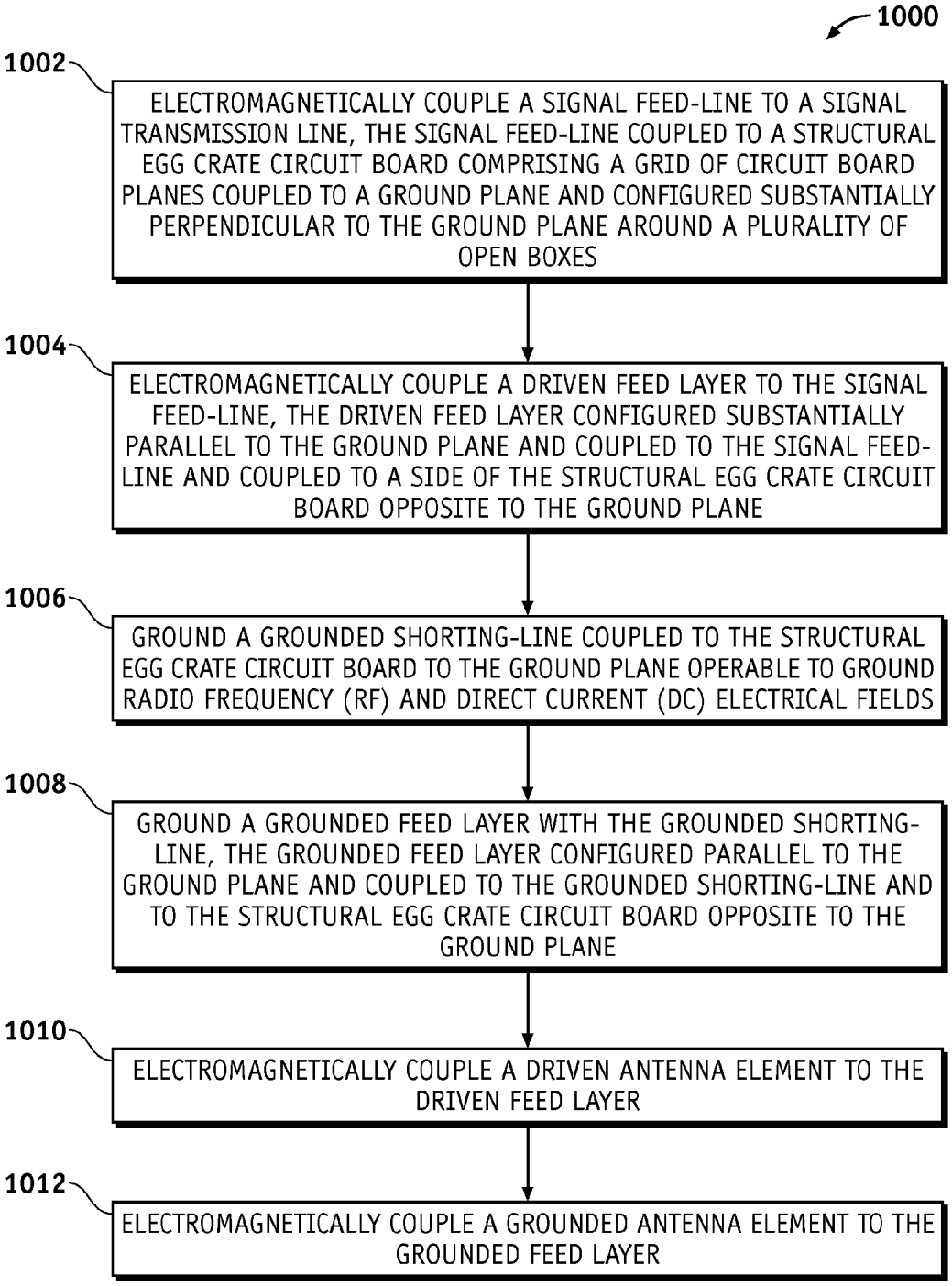
FIG. 10 is an illustration of an exemplary process for operating a structural wideband multifunctional aperture according to an embodiment of the disclosure.

FIG. 10 is an illustration of an exemplary process 1000 for operating a structural wideband multifunctional aperture according to an embodiment of the disclosure. The various tasks performed in connection with process 1000 may be performed mechanically, by software, hardware, firmware, computer-readable software, computer readable storage medium, or any combination thereof. The process 1000 may be recorded in a computer-readable medium such as a semiconductor memory, a magnetic disk, an optical disk, and the like, and can be accessed and executed, for example, by a computer CPU in which the computer-readable medium is stored.

For illustrative purposes, the following description of process 1000 may refer to elements mentioned above in connection with FIGS. 1-2. In some embodiments, portions of the process 1000 may be performed by different elements of the structural wideband multifunctional aperture 100 such as: the structural egg crate circuit board 112, the feed-line 312, the grounded shorting-line 314, the grounded shorting-line 316, etc. It should be appreciated that process 1000 may include any number of additional or alternative tasks, the tasks shown in FIG. 10 need not be performed in the illustrated order, and the process 1000 may be incorporated into a more comprehensive procedure or process having additional functionality not described in detail herein.

Process 1000 may begin by electromagnetically coupling a signal feed-line 312 to a signal transmission line 402, the signal feed-line 312 coupled to a structural egg crate circuit board 112 comprising a grid of circuit board planes coupled to a ground plane 104 and configured substantially perpendicular to the ground plane 104 around a plurality of open boxes 114/116 (task 1002).

Process 1000 may continue by electromagnetically coupling a driven feed layer 722/720 to the signal feed-line 312, the driven feed layer 716-722 configured substantially parallel to the ground plane 104 and coupled to the signal feed-line 312 and coupled to a side of the structural egg crate circuit board 112 opposite to the ground plane 104 (task 1004). The driven feed layer 722/720 may comprise a single driven feed-layer element 722/720, or any suitable number of the feed layer elements 722/720.

Process 1000 may continue by grounding a grounded shorting-line 314/316 coupled to the structural egg crate circuit board 112 to the ground plane 104 operable to ground radio frequency (RF) and direct current (DC) electrical fields (task 1006).

Process 1000 may continue grounding a grounded feed layer 716/718 with the grounded shorting-line 314/316, the grounded feed layer 716/718 configured parallel to the ground plane 104 and coupled to the grounded shorting-line 314/316 and to the structural egg crate circuit board 112 opposite to the ground plane 104 (task 1008). The grounded feed layer 716/718 may comprise a single driven grounded feed layer element 716/718, or any suitable number of the grounded feed layer elements 716/718.

Process 1000 may continue by electromagnetically coupling a driven antenna element 302/306 to the driven feed layer 716-722 (task 1010).

Process 1000 may continue by electromagnetically coupling a grounded antenna element 304/308 to the grounded feed layer 716/718 (task 1012).

FIG. 11 is an illustration of an exemplary structural wideband multifunctional aperture comprising a sandwich panel configuration 1100 (sandwich panel 1100) according to an embodiment of the disclosure. The structural wideband multifunctional aperture 100 may be configured in the sandwich panel 1100 comprising the structural egg crate circuit board 112 sandwiched between one or more facing sheet 1104 and one or more backing sheet 1102. The facing sheet 1104 and the backing sheet 1102 may provide additional stiffness to the structural egg crate circuit board 112. The facing sheet 1104 and the backing sheet 1102 may each comprise, for example but without limitation, a low dielectric quartz fabric or other low di-electric material. For example, the low dielectric quartz fabric may be compatible with high temperature and provides high strength structural integrity. Such quartz fabrics may comprise, for example but without limitation, 99.95% SiO2 quartz crystals providing low dielectric loss properties.

FIG. 12 is an illustration of an expanded view 1200 of the sandwich panel configuration 1100 of FIG. 11. The antenna elements 108/110 (antenna layer) in the antenna layer 504 and the combined antenna/feed layer 505, the feed layer 506 are configured in a plane 1202 above the facing sheet 1104. The ground plane 104 may be configured above or below the backing sheet 1102. Furthermore, electronics can be attached below the backing sheet 1102 and the ground plane 104. The antenna elements 108/110, signal feed-lines 312, grounded shorting-lines 314, and grounded shorting-lines 316 are to be configured in the sandwich panel 1100. The dielectric cover 106 covers the bow-tie antenna elements 108/110, and the structural egg crate circuit board 112 incorporates the signal feed-lines 312, the grounded shorting-lines 314, and the grounded shorting-lines 316.

The sandwich panel 1100 may be integrated into a structure of a vehicle such as an aircraft. For example, the sandwich panel 1100 may be integrated into an outer composite skin of an aircraft. The structural wideband multifunctional aperture 100 is configured to function under a structural loading of the aircraft. Furthermore, the antenna elements 108/110, the signal feed-lines 312, the grounded shorting-lines 314, the grounded shorting-lines 316, and other interconnects, connections, and electronics are configured to function under a structural loading of the aircraft.

In this manner, embodiments of the disclosure provide an antenna element with wide bandwidth and better than, for example, about 50-degree conical scan volume for the creation of conformal arrays and antennas. The design approach provides effective gain within, for example, about 2 to 3 dB of an ideal gain possible for a surface area of a unit-cell for an antenna element. The element design can be used as a wideband antenna and/or array. Embodiments of the disclosure can be used in multifunction and/or shared antenna configuration for communications, electronic warfare, and signal intelligence applications and multiple combinations of multiple applications. Embodiments of the disclosure not only provide wide-bandwidth coverage, but provide polarization diversity to allow transmission and reception of signals with any arbitrary polarization that includes, but not exclusive to linear, circular, and slant polarized signals. Embodiments of the disclosure can be scaled to a frequency band with a matching bandwidth ratio (e.g. 5:1) from a highest to a lowest frequency of desired coverage.

Antenna integration into structure provides a significant advancement of aperture technologies over traditional apertures as traditional apertures are rigid/non-load bearing members and are not allowed to flex. This limits a size and locations of apertures onto aircraft. Integrating the aperture into the structure allows: 1) a larger size aperture as the aperture is the structure of the aircraft, 2) for more flexibility of the location of the aperture on the platform, and 3) the aperture to be installed in small and medium size UAV's adding to their mission capabilities.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-8 depict example arrangements of elements, additional intervening elements, devices, features, or components may be present in an embodiment of the disclosure.

As used herein, unless expressly stated otherwise, "substantially" means may comprise a minor deviation due to measuring devices, fabrication processes, testing environments, material properties, or similar factors. For example, substantially perpendicular means may comprise a minor deviation from a 90 degree angle. Similarly, substantially parallel means may comprise a minor deviation from being parallel.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. A structural wideband multifunctional aperture comprising:

a ground plane operable to ground radio frequency (RF) and direct current (DC) electrical fields;

a structural egg crate circuit board comprising a grid of circuit board planes coupled to the ground plane and configured substantially perpendicular to the ground plane around a plurality of open boxes, and operable to support a structural load;

a signal feed-line coupled to the structural egg crate circuit board and operable to couple to a signal transmission line, and configured perpendicular to the ground plane; and a driven feed layer configured substantially parallel to the ground plane and coupled to the signal feed-line and to a side of the structural egg crate circuit board opposite to the ground plane wherein the driven feed layer is configured in a unit cell for an electronically steerable array.

2. The structural wideband multifunctional aperture of claim 1, further comprising:

a grounded shorting-line coupled to the structural egg crate circuit board and the ground plane; and a grounded feed layer configured parallel to the ground plane and coupled to the grounded shorting-line and to the structural egg crate circuit board opposite to the ground plane.

3. The structural wideband multifunctional aperture of claim 2, wherein the driven feed layer and the grounded feed layer comprise a trapezoidal configuration.

4. The structural wideband multifunctional aperture of claim 2, further comprising:

a driven antenna element configured to electromagnetically couple to the driven feed layer; and a grounded antenna element configured to electromagnetically couple to the grounded feed layer.

5. The structural wideband multifunctional aperture of claim 4, wherein the driven antenna element and the grounded antenna element comprise a bow-tie configuration.

6. The structural wideband multifunctional aperture of claim 4, further comprising a dielectric cover covering the driven antenna element and the grounded antenna element, wherein the dielectric cover comprises one of: a single layer comprising low electromagnetic loss material, a plurality of layers comprising differing low electromagnetic loss materials.

7. The structural wideband multifunctional aperture of claim 1, wherein the structural wideband multifunctional aperture comprises an aircraft skin, and is configured to bear loads on the aircraft skin.

8. The structural wideband multifunctional aperture of claim 1, wherein the structural egg crate circuit board comprises a low dielectric quartz fabric.

9. The structural wideband multifunctional aperture of claim 1, wherein the open boxes are filled with a low dielectric material.

10. The structural wideband multifunctional aperture of claim 1, wherein the structural wideband multifunctional aperture is configured as a dual-polarized dipole antenna structure.

11. The structural wideband multifunctional aperture of claim 10, wherein the structural wideband multifunctional aperture is configured with a matching bandwidth ratio of at least 5:1 of high frequency to low frequency.

12. The structural wideband multifunctional aperture of claim 1, wherein the structural wideband multifunctional aperture is configured with a matching bandwidth ratio of at least 5:1 of high frequency to low frequency.

13. A method for forming a structural wideband multifunctional aperture comprising:

coupling a structural egg crate circuit board comprising a grid of circuit board planes to a ground plane;

configuring the structural egg crate circuit board substantially perpendicular to the ground plane around a plurality of open boxes, and to support a structural load;

coupling a signal feed-line to the structural egg crate circuit board, the signal feed-line operable to couple to a signal transmission line, and configured perpendicular to the ground plane, wherein the driven feed layer is configured in a unit cell for an electronically steerable array;

configuring a driven feed layer substantially parallel to the ground plane; and coupling the driven feed layer to the signal feed-line and to a side of the structural egg crate circuit board opposite to the ground plane.

14. The method of claim 13, further comprising:

coupling a grounded shorting-line to the structural egg crate circuit board and the ground plane;

configuring a grounded feed layer parallel to the ground plane; and coupling the grounded feed layer to the grounded shorting-line and to the structural egg crate circuit board opposite to the ground plane.

15. The method of claim 14, further comprising configuring the driven feed layer and the grounded feed layer in a trapezoidal configuration.

16. The method of claim 14, further comprising:

configuring a driven antenna element to electromagnetically couple to the driven feed layer; and configuring a grounded antenna element to electromagnetically couple to the grounded feed layer.

17. The method of claim 16, further comprising configuring the driven antenna element and the grounded antenna to comprise a bow-tie configuration.

18. The method of claim 13, further comprising filling the open boxes with a low dielectric material.

19. The method of claim 13, further comprising configuring an aircraft skin comprising the structural wideband multifunctional aperture.

20. The method of claim 13, further comprising configuring the ground plane to ground radio frequency (RF) and direct current (DC) electrical fields.

21. The structural wideband multifunctional aperture of claim 13, wherein the structural wideband multifunctional aperture is configured as a dual-polarized dipole antenna structure.

22. The structural wideband multifunctional aperture of claim 13, wherein the structural wideband multifunctional aperture is configured with a matching bandwidth ratio of at least 5:1 of high frequency to low frequency.

23. A method for operating a structural wideband multifunctional aperture comprising:

electromagnetically coupling a signal feed-line to a signal transmission line, the signal feed-line configured perpendicular to the ground plane and coupled to a structural egg crate circuit board comprising a grid of circuit board planes coupled to a ground plane and configured substantially perpendicular to the ground plane around a plurality of open boxes and operable to support a structural load; and electromagnetically coupling a driven feed layer to the signal feed-line, the driven feed layer configured substantially parallel to the ground plane and coupled to the signal feed-line and coupled to a side of the structural egg crate circuit board opposite to the ground plane, wherein the driven feed layer is configured in a unit cell for an electronically steerable array.

24. The method of claim 23, further comprising:

grounding a grounded shorting-line coupled to the structural egg crate circuit board to the ground plane operable to ground radio frequency (RF) and direct current (DC) electrical fields; and grounding a grounded feed layer with the grounded shorting-line, the grounded feed layer configured parallel to the ground plane and coupled to the grounded shorting-line and to the structural egg crate circuit board opposite to the ground plane.

25. The method of claim 24, further comprising:

electromagnetically coupling a driven antenna element to the driven feed layer; and electromagnetically coupling a grounded antenna element to the grounded feed layer.

26. The method of claim 23, wherein the structural wideband multifunctional aperture is configured as a dual-polarized dipole antenna structure.

27. The method of claim right above 26, wherein the structural wideband multifunctional aperture is configured with a matching bandwidth ratio of at least 5:1 of high frequency to low frequency.

28. The method of claim 23, wherein the structural wideband multifunctional aperture is configured with a matching bandwidth ratio of at least 5:1 of high frequency to low frequency.

29. A structural wideband multifunctional aperture comprising:

a ground plane operable to ground radio frequency (RF) and direct current (DC) electrical fields;

a structural egg crate circuit board comprising a grid of circuit board planes coupled to the ground plane and configured substantially perpendicular to the ground plane around a plurality of open boxes, and operable to support a structural load;

a signal feed-line coupled to the structural egg crate circuit board and operable to couple to a signal transmission line, and configured perpendicular to the ground plane; and a driven feed layer configured substantially parallel to the ground plane and coupled to the signal feed-line and to a side of the structural egg crate circuit board opposite to the ground plane wherein the structural wideband multifunctional aperture is configured as a dual-polarized dipole antenna structure.

30. The structural wideband multifunctional aperture of claim 29, wherein the structural wideband multifunctional aperture is configured with a matching bandwidth ratio of at least 5:1 of high frequency to low frequency.

31. A structural wideband multifunctional aperture comprising:

a ground plane operable to ground radio frequency (RF) and direct current (DC) electrical fields;

a structural egg crate circuit board comprising a grid of circuit board planes coupled to the ground plane and configured substantially perpendicular to the ground plane around a plurality of open boxes, and operable to support a structural load;

a signal feed-line coupled to the structural egg crate circuit board and operable to couple to a signal transmission line, and configured perpendicular to the ground plane; and a driven feed layer configured substantially parallel to the ground plane and coupled to the signal feed-line and to a side of the structural egg crate circuit board opposite to the ground plane wherein the structural wideband multifunctional aperture is configured with a matching bandwidth ratio of at least 5:1 of high frequency to low frequency.

32. A method for forming a structural wideband multifunctional aperture comprising:

coupling a structural egg crate circuit board comprising a grid of circuit board planes to a ground plane;

configuring the structural egg crate circuit board substantially perpendicular to the ground plane around a plurality of open boxes, and to support a structural load;

coupling a signal feed-line to the structural egg crate circuit board, the signal feed-line operable to couple to a signal transmission line, and configured perpendicular to the ground plane;

configuring a driven feed layer substantially parallel to the ground plane; and coupling the driven feed layer to the signal feed-line and to a side of the structural egg crate circuit board opposite to the ground plane wherein the structural wideband multifunctional aperture is configured as a dual-polarized dipole antenna structure.

33. The structural wideband multifunctional aperture of claim 32, wherein the structural wideband multifunctional aperture is configured with a matching bandwidth ratio of at least 5:1 of high frequency to low frequency.

34. The structural wideband multifunctional aperture of claim 33, wherein the driven feed layer is configured in a unit cell for an electronically steerable array.

35. A method for forming a structural wideband multifunctional aperture comprising:

coupling a structural egg crate circuit board comprising a grid of circuit board planes to a ground plane;

configuring the structural egg crate circuit board substantially perpendicular to the ground plane around a plurality of open boxes, and to support a structural load;

coupling a signal feed-line to the structural egg crate circuit board, the signal feed-line operable to couple to a signal transmission line, and configured perpendicular to the ground plane;

configuring a driven feed layer substantially parallel to the ground plane; and coupling the driven feed layer to the signal feed-line and to a side of the structural egg crate circuit board opposite to the ground plane;

wherein the structural wideband multifunctional aperture is configured with a matching bandwidth ratio of at least 5:1 of high frequency to low frequency.

36. A method for operating a structural wideband multifunctional aperture comprising:

electromagnetically coupling a signal feed-line to a signal transmission line, the signal feed-line configured perpendicular to the ground plane and coupled to a structural egg crate circuit board comprising a grid of circuit board planes coupled to a ground plane and configured substantially perpendicular to the ground plane around a plurality of open boxes and operable to support a structural load; and electromagnetically coupling a driven feed layer to the signal feed-line, the driven feed layer configured substantially parallel to the ground plane and coupled to the signal feed-line and coupled to a side of the structural egg crate circuit board opposite to the ground plane, wherein the structural wideband multifunctional aperture is configured as a dual-polarized dipole antenna structure.

37. The method of claim 36, wherein the structural wideband multifunctional aperture is configured with a matching bandwidth ratio of at least 5:1 of high frequency to low frequency.

38. A method for operating a structural wideband multifunctional aperture comprising:

electromagnetically coupling a signal feed-line to a signal transmission line, the signal feed-line configured perpendicular to the ground plane and coupled to a structural egg crate circuit board comprising a grid of circuit board planes coupled to a ground plane and configured substantially perpendicular to the ground plane around a plurality of open boxes and operable to support a structural load; and electromagnetically coupling a driven feed layer to the signal feed-line, the driven feed layer configured substantially parallel to the ground plane and coupled to the signal feed-line and coupled to a side of the structural egg crate circuit board opposite to the ground plane wherein the structural wideband multifunctional aperture is configured with a matching bandwidth ratio of at least 5:1 of high frequency to low frequency.

* * * * *